US008286310B1

(12) United States Patent
Negron

(10) Patent No.: US 8,286,310 B1
(45) Date of Patent: Oct. 16, 2012

(54) PAD STAY

(75) Inventor: Felipe Negron, New York, NY (US)

(73) Assignee: Felipe Negron, New York, NY (US)

( * ) Notice: Subject to any disclaimer, the term of this patent is extended or adjusted under 35 U.S.C. 154(b) by 243 days.

(21) Appl. No.: 12/378,440

(22) Filed: Feb. 17, 2009

(51) Int. Cl.
*A44B 99/00* (2010.01)
*E05D 15/00* (2006.01)

(52) U.S. Cl. ..... 24/306; 24/304; 24/3.13; 16/87 R

(58) Field of Classification Search ..... 24/716, 24/3.13, 457, 304, 306; 160/87 R, 87.2; 16/87 R, 87.2
See application file for complete search history.

(56) References Cited

U.S. PATENT DOCUMENTS

| | | | | | |
|---|---|---|---|---|---|
| 249,293 | A * | 11/1881 | Blinn | 24/716 |
| 1,141,992 | A * | 6/1915 | Toelcke | 24/3.13 |
| 2,302,341 | A * | 11/1942 | Nash | 16/87.2 |
| 2,320,308 | A * | 5/1943 | Silverman | 16/87.2 |
| 4,432,120 | A * | 2/1984 | Sherman | 24/304 |
| 2005/0235462 | A1 * | 10/2005 | Takahashi et al. | 24/306 |
| 2007/0271736 | A1 * | 11/2007 | Hanley | 16/87 R |

* cited by examiner

*Primary Examiner* — Robert Sandy

(57) ABSTRACT

An elevator pad securing system that is suited for residential and commercial building use; respectfully including a plastic disk with a channeled groove, rivet hole and the hook portion of Velcro, an offset coupling attached to plastic disk with a rivet then a small length of ball chain with one end attached onto the offset coupling on the plastic disk with the opposite end of the ball chain attached to the offset coupling attached to the top edge of the elevator pad and a defined dimension of the loop portion of Velcro attached to the upper back portion of the elevator pad.

4 Claims, 3 Drawing Sheets

PAD STAY

This invention relates to elevator pads. It is specifically applicable to the securing of the elevator pads which are used in the service elevators of residential and commercial buildings.

BACKGROUND OF THE INVENTION

Many of us have moved into residential buildings from one apartment to another. Businesses that need to establish an office move their business in or out of commercial buildings. At present, when a move-in or move-out occurs, a service elevator is used. When the service elevator is used the maintenance staff hangs up elevator pads to protect the elevator cab walls against damage during the move-in or move-out process. Elevator pads are also hung for deliveries that may cause damages. Presently, there are several methods for hanging elevator pads in the elevators. There are various hooks and clamps available to hang the elevator pads onto the elevators walls. Most elevators are equipped with hanging/wall studs of various dimensions and configurations. Currently, neither of the hanging mechanisms prevents the elevator pads from being dislodged during a move-in, move-out or delivery.

THE OBJECT OF THE INVENTION

It is the object of the invention to provide residential and commercial buildings with a method to secure the elevator pads onto the elevator hanging/wall studs until they are ready to be removed. Another, objective of the invention is to prevent damage to the interior of the elevator, which will equate into unnecessary repair cost.

SUMMARY OF THE INVENTION

In accordance with the invention, the pad stay comprises of a plastic disk with a hole, grooved channel, hook and loop portions of Velcro, two brass rivet, two brass couplings and a small length of ball chain.

DESCRIPTION OF THE PREFERRED EMBODIMENT

Figure 1:
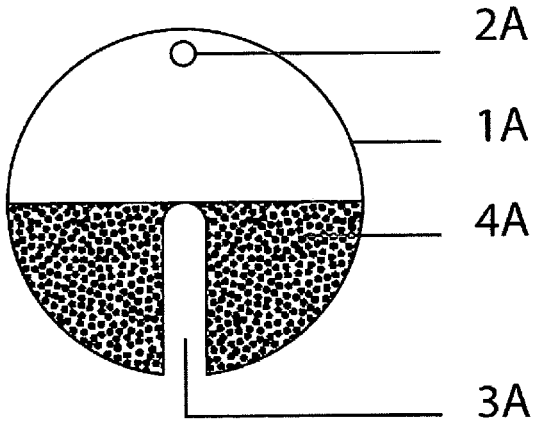
FIG. 1 is a front view of the pad stay with channeled groove, rivet hole and the hook portion of Velcro.

Referring to FIG. 1, as shown, incorporates the attributes of the invention which consist of a plastic disk of a specific dimension 1A with a groove channel 3A from one end of it's perimeter to the center of the plastic disk, and a hole 2A on the opposite end of the grooved channel 3A.

In addition, the hook portion of Velcro 4A is attached half way up the backside of the diameter plastic disk 1A and made to conform to the perimeter of the plastic disk 1A and grooved channel 3A of the plastic disk.

Figure 2:
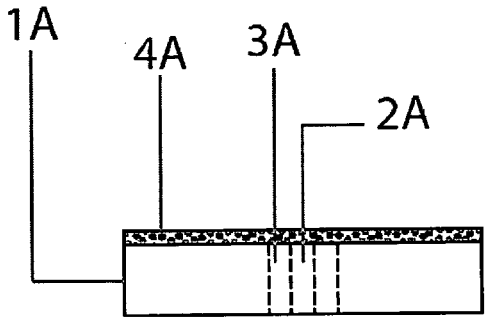
FIG. 2 is the bottom view of the pad stay with the hook portion of Velcro, hash lines depicting the location of the rivet hole and channeled groove

Referring to FIG. 2, a bottom view as shown incorporates the attributes of the invention which consist of a plastic disk of a specific dimension 1A with a groove channel 3A from one end of it's perimeter to the center of the plastic disk, the hook portion of Velcro 4A and a hole 2A on the opposite end of the grooved channel 3A.

Figure 3:
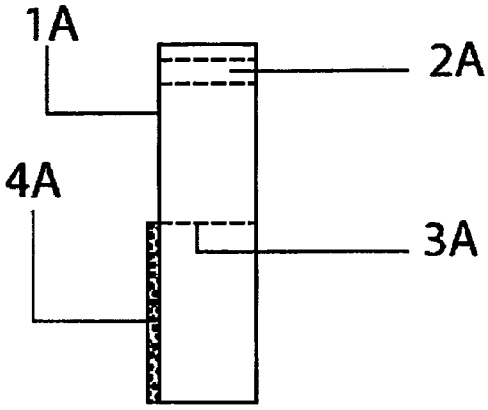
FIG. 3 is the side view of the pad stay, the hook portion of Velcro and hash lines depicting location of the rivet hole and grooved channel

Referring to FIG. 3, a side view as shown incorporates the attributes of the invention which consist of a plastic disk of a specific dimension 1A with a groove channel 3A from one end of it's perimeter to the center of the plastic disk and a hole 2A on the opposite end of the grooved channel 3A and the hook portion of Velcro 4A.

Figure 4:
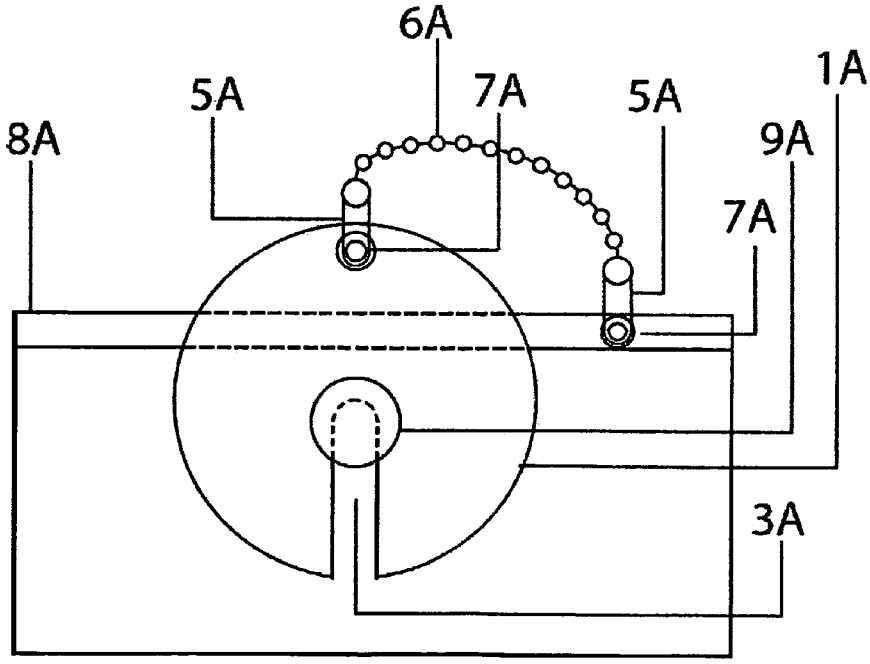
FIG. 4 is a view of the pad stay attached to the elevator hanging/wall stud, elevator pad, offset couplings, rivets and small length of ball chain.

Referring to FIG. 4, as shown, incorporates the attributes of the invention which consist of a plastic disk of a specific dimension 1A with a groove channel 3A from one end of the plastic disk's perimeter to the center of the plastic disk 1A.

In addition, the pad stay 1A is slipped onto the elevator hanging/wall stud 9A via the grooved channel 3A on the plastic disk, an offset coupling 5A attached to the hole 2A on the plastic disk 1A with a rivet 7A, a small length of ball chain 6A is engaged onto the offset coupling 5A on the plastic disk 1A, with the opposite end of the small length of chain 6A engaged onto another offset coupling 5A attached to the top edge portion of the elevator pad 8A.

Figure 5:
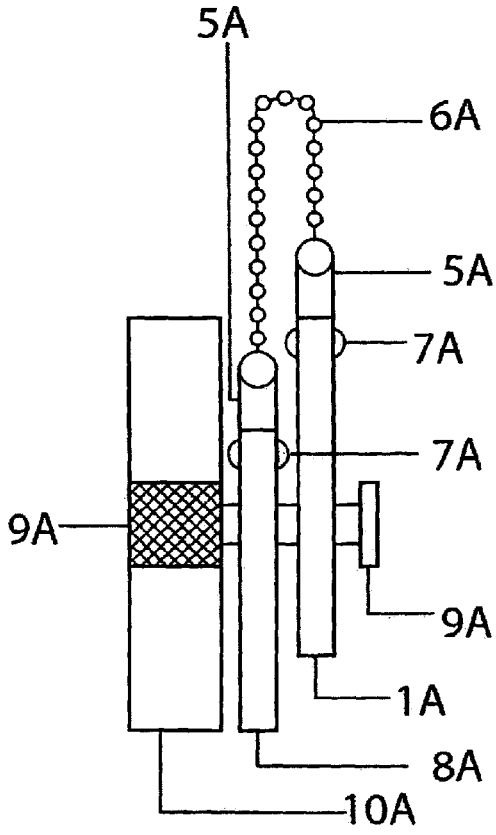
FIG. 5 is a side view of the pad stay attached to the elevator hanging/wall stud, elevator wall, elevator pad, offset couplings, rivets and small length of ball chain.

Referring to FIG. 5, a side view as shown incorporates the attributes of the invention which consist of a plastic disk of a specific dimension 1A with a groove channel 3A from one end of the plastic disk's perimeter to the center of the plastic disc 1A.

In addition, the elevator wall 10A is equipped with hanging/wall studs 9A the pad stay 1A is slipped onto the hanging/wall studs 9A via the grooved channel 3A on the plastic disk, an offset coupling 5A attached to the hole 2A on the plastic disk 1A with a rivet 7A, a small length of ball chain 6A is engaged onto the offset coupling 5A on the plastic disc 1A, with the opposite end of the small length of ball chain 6A engaged onto another offset coupling 5A attached to the top edge portion of the elevator pad 8A.

Figure 6:
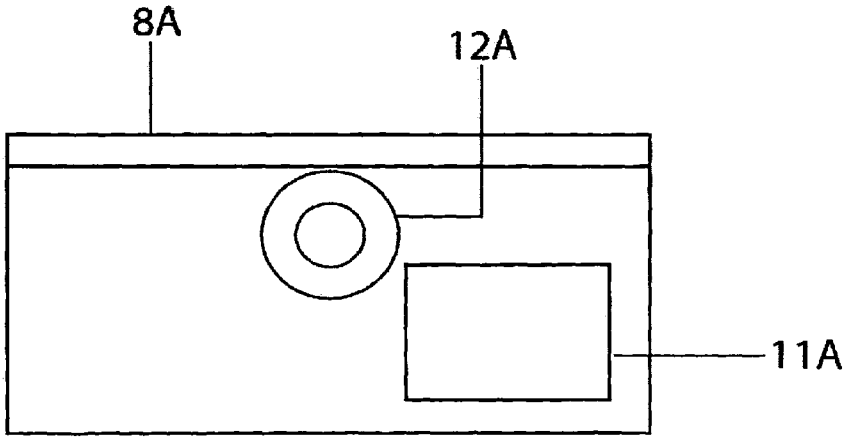
FIG. 6 is a back view of the elevator pad with the loop portion of Velcro attached.

Referring to FIG. 6, a back view as shown incorporates the attributes of the invention which consist of the loop portion of Velcro 11A, hanging grommet hole 12A on elevator pad 8A.

What is claimed is:

1. An elevator pad securing system comprising of:

a plastic disk with a channeled groove, a rivet hole and a hook portion of a hook and loop fastener, an offset coupling being attached to the plastic disk with a rivet, a small length of ball chain with one end attached onto the offset coupling then onto the plastic disk, an opposite end of the ball chain is then attached to the offset coupling which is attached to the top edge of the elevator pad, a defined dimension of a loop portion of the hook and loop fastener is attached to the upper back portion of the elevator pad.

2. The elevator pad securing system according to claim 1, wherein said plastic disk is attached to elevator hanging/wall studs via a grooved channel of the plastic disk, the elevator pad securing system is also attached onto the elevator pad via an the offset coupling with the ball chain to prevent lost of the elevator pad securing system plastic disk.

3. The elevator pad securing system according to claim 1, wherein the plastic disk has the hook portion of the hook and loop fastener affixed to the upper back portion which is used to attach the plastic disk of the elevator pad securing system to the loop portion of the hook and loop fastener which is attached to the back portion of the elevator pad.

4. The elevator pad securing system according to claim 1, wherein the plastic disk can be constructed out of metal as an alternative to plastic.

* * * * *